US009805647B2

(12) United States Patent
Kim

(10) Patent No.: US 9,805,647 B2
(45) Date of Patent: Oct. 31, 2017

(54) ORGANIC LIGHT EMITTING DISPLAY INCLUDING DEMULTIPLEXER AND DRIVING METHOD THEREOF

(71) Applicant: Samsung Display Co., Ltd., Yongin, Gyeonggi-Do (KR)

(72) Inventor: Yang-Wan Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 165 days.

(21) Appl. No.: 14/066,649

(22) Filed: Oct. 29, 2013

(65) Prior Publication Data

US 2015/0002379 A1 Jan. 1, 2015

(30) Foreign Application Priority Data

Jun. 26, 2013 (KR) ..... 10-2013-0073425

(51) Int. Cl.
*G09G 3/30* (2006.01)
*G09G 3/3233* (2016.01)

(52) U.S. Cl.
CPC ... *G09G 3/3233* (2013.01); *G09G 2300/0819* (2013.01); *G09G 2300/0842* (2013.01); *G09G 2300/0861* (2013.01); *G09G 2310/0297* (2013.01); *G09G 2320/0242* (2013.01)

(58) Field of Classification Search
CPC ..... G09G 3/30–3/3291
See application file for complete search history.

(56) References Cited

U.S. PATENT DOCUMENTS

| | | | | |
|---|---|---|---|---|
| 6,362,798 | B1 | 3/2002 | Kimura et al. | |
| 2005/0243034 | A1* | 11/2005 | Chung | G09G 3/3275 345/76 |
| 2006/0151745 | A1* | 7/2006 | Kim et al. | 252/301.16 |
| 2008/0055304 | A1* | 3/2008 | Ryu et al. | 345/214 |
| 2009/0002280 | A1 | 1/2009 | Kim et al. | |
| 2009/0207110 | A1* | 8/2009 | Lee et al. | 345/82 |
| 2011/0025678 | A1 | 2/2011 | Chung | |

FOREIGN PATENT DOCUMENTS

| | | | |
|---|---|---|---|
| KR | 10-2008-0113981 | A | 12/2008 |
| KR | 10-2011-0011940 | A | 2/2011 |

* cited by examiner

*Primary Examiner* — Sanghyuk Park
(74) *Attorney, Agent, or Firm* — Lewis Roca Rothgerber Christie LLP

(57) ABSTRACT

An organic light emitting display includes first sub-pixels, second sub-pixels and third sub-pixels at an area defined by scan lines and data lines; a data driver configured to supply an initialization voltage and data signals to output lines; demultiplexers coupled to respective ones of the output lines, each demultiplexer being configured to supply a plurality of the data signals to a plurality of the data lines; and a demultiplexer controller configured to control the demultiplexer so that data signals are concurrently supplied to at least one of the first sub-pixels, the second sub-pixels or the third sub-pixels.

9 Claims, 3 Drawing Sheets

ORGANIC LIGHT EMITTING DISPLAY INCLUDING DEMULTIPLEXER AND DRIVING METHOD THEREOF

CROSS-REFERENCE TO RELATED APPLICATION

This application claims priority to and the benefit of Korean Patent Application No. 10-2013-0073425, filed on Jun. 26, 2013, in the Korean Intellectual Property Office, the entire contents of which are incorporated herein by reference in their entirety.

BACKGROUND

1. Field

Embodiments of the present invention relate to an organic light emitting display and a driving method thereof.

2. Description of the Related Art

With the development of information technologies, the importance of a display that is a connection medium between information has increased. Accordingly, flat panel displays (FPDs) such as a liquid crystal display (LCD), an organic light emitting display and a plasma display panel (PDP) have been increasingly used.

Among these FPDs, the organic light emitting display displays images using organic light emitting diodes (OLEDs) that emit light through recombination of electrons and holes. The organic light emitting display has a fast response speed and may be driven with low power consumption.

SUMMARY

Embodiments provide an organic light emitting display and a driving method thereof, which may increase (or improve) display quality.

According to an embodiment of the present invention, there is provided an organic light emitting display including: first sub-pixels, second sub-pixels and third sub-pixels at an area defined by scan lines and data lines; a data driver configured to supply an initialization voltage and data signals to output lines; demultiplexers coupled to respective ones of the output lines, each demultiplexer being configured to supply a plurality of the data signals to a plurality of the data lines; and a demultiplexer controller configured to control the demultiplexer so that data signals are concurrently supplied to at least one of the first sub-pixels, the second sub-pixels or the third sub-pixels.

The demultiplexer controller may be configured to control the demultiplexer so that the initialization voltage is supplied to the data lines during a first period in a horizontal period, one of the data signals is supplied to the first sub-pixels during a second period in the horizontal period, and another one of the data signals is supplied to the second sub-pixels during a third period in the horizontal period.

The first sub-pixels may be green sub-pixels configured to generate green light.

The second sub-pixels may be red sub-pixels configured to generate red light.

One of the data signals supplied to the third sub-pixels may be supplied during the second and third periods.

The organic light emitting display may further include a timing controller configured to rearrange external data, corresponding to an order of the data signals supplied to the first sub-pixels, the second sub-pixels and the third sub-pixels, and configured to supply the rearranged data to the data driver.

Each of the demultiplexers may include a first switch and a second switch, wherein the first switch coupled to an i-th (i is 1, 4, 7, . . . ) output line may be turned on when a first control signal is supplied from the demultiplexer controller, and the second switch coupled to the i-th output line may be turned on when a second control signal is supplied from the demultiplexer controller, and wherein the first switch coupled to (i+1)-th and (i+2)-th output lines may be turned on when the second control signal is supplied from the demultiplexer controller, and the second switch coupled to the (i+1)-th and (i+2)-th output lines may be turned on when the first control signal is supplied from the demultiplexer controller.

The demultiplexer controller may be configured to supply the first and second control signals during the first period, supply the second control signal during the second period, and supply the first control signal during the third period.

The first switch may be coupled to one of the data lines at one side of the demultiplexer, wherein the second switch may be coupled to one of the data lines at an other side of the demultiplexer.

The initialization voltage may be a voltage lower than a voltage of the data signals.

According to another embodiment of the present invention, there is provided a method of driving an organic light emitting display, the method including: supplying an initialization voltage to data lines via a demultiplexer during a first period in a horizontal period; supplying a first data signal to first sub-pixels via the demultiplexer during a second period in the horizontal period; and supplying a second data signal to second sub-pixels via the demultiplexer during a third period in the horizontal period.

The initialization voltage may be a voltage lower than a voltage of the data signals.

The first sub-pixels may be green sub-pixels configured to generate green light.

The second sub-pixels may be red sub-pixels configured to generate red light.

A third data signal may be supplied to some of third sub-pixels during the second period, and a fourth data signal may be supplied to others of the third sub-pixels during the third period.

BRIEF DESCRIPTION OF THE DRAWINGS

Example embodiments will now be described more fully hereinafter with reference to the accompanying drawings; however, they may be embodied in different forms and should not be construed as limited to the embodiments set forth herein. Rather, these embodiments are provided so that this disclosure will be thorough and complete, and will fully convey the scope of the example embodiments to those skilled in the art.

In the drawing figures, dimensions may be exaggerated for clarity of illustration. It will be understood that when an element is referred to as being "between" two elements, it can be the only element between the two elements, or one or more intervening elements may also be present. Like reference numerals refer to like elements throughout.

DETAILED DESCRIPTION

Figure 1:
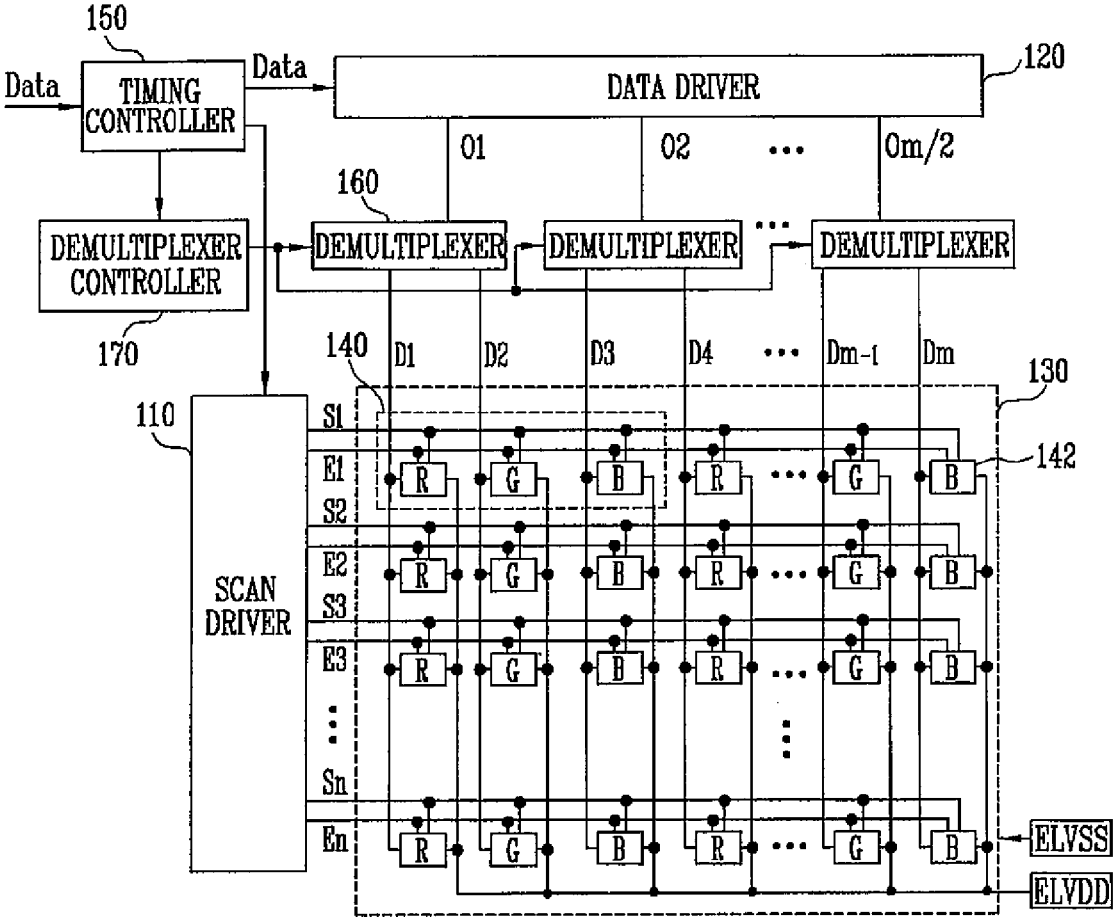
FIG. 1 is a diagram illustrating an organic light emitting display according to an embodiment of the present invention.

Hereinafter, certain exemplary embodiments according to the present invention will be described with reference to the accompanying drawings. Here, when a first element is described as being coupled to a second element, the first element may be not only directly coupled to the second element but may also be indirectly coupled to the second element via a third element. Further, some of the elements that are not essential to the complete understanding of the invention may be omitted for clarity. Also, like reference numerals refer to like elements throughout.

FIG. 1 is a block diagram illustrating an organic light emitting display according to an embodiment of the present invention.

Referring to FIG. 1, the organic light emitting display according to this embodiment includes a scan driver 110, a data driver 120, a display unit 130, a timing controller 150, demultiplexers 160 and a demultiplexer controller 170.

The display unit 130 includes sub-pixels 142 positioned at crossing regions of scan lines S1 to Sn and data lines D1 to Dm. The sub-pixels 142 are divided into red sub-pixels R configured to generate red light, green sub-pixels G configured to generate green light, and blue sub-pixels B configured to generate blue light. Red, green and blue sub-pixels R, G and B that are adjacent to one another constitute a pixel 140.

Each sub-pixel 142 receives first and second power sources ELVDD and ELVSS supplied from the outside of the organic light emitting display. Sub-pixels 142 receive a data signal while being selected for each horizontal line, corresponding to a scan signal supplied to the scan lines S1 to Sn. Each sub-pixel 142 receiving the data signal generates light with a specific luminance (e.g., a predetermined luminance) while controlling the amount of current flowing from the first power source ELVDD to the second power source ELVSS via an organic light emitting diode.

The scan driver 110 generates a scan signal under the control of the timing controller 150, and supplies the generated scan signal to the scan lines S1 to Sn. For example, the scan driver 110 may progressively (e.g., sequentially) supply the scan signal to the scan lines S1 to Sn. The scan driver 110 generates an emission control signal under the control of the timing controller 150, and supplies the generated emission control signal to emission control lines E1 to En. For example, the scan driver 110 may supply the emission control signal to a j-th (j is a natural number) emission control line Ej so that the emission control signal is overlapped with the scan signal supplied to (j−1)-th and j-th scan lines Sj−1 and Sj. Additionally, in some embodiments, the emission control lines E1 to En may be eliminated corresponding to the circuit structure of the sub-pixel 142.

The data driver 120 progressively (e.g., sequentially) supplies an initialization voltage and a plurality of data signals to output lines O1 to Om/2. For example, the data driver 120 may progressively (e.g., sequentially) supply the initialization voltage and two data signals to each of the output lines O1 to Om/2 for each horizontal period in which the scan signal is supplied. Here, the initialization voltage may be set to a voltage lower than the data signal.

The demultiplexers 160 are respectively coupled to the output lines O1 to Om/2. The demultiplexer 160 is coupled to a plurality of data lines D. For example, each demultiplexer 160 may be coupled to two data lines D. The demultiplexer 160 supplies the initialization voltage to the plurality of data lines D for each horizontal period. The demultiplexer 160 progressively (e.g., sequentially) supplies a plurality of data signals to the data lines D coupled thereto for each horizontal period.

The demultiplexer controller 170 supplies a plurality of control signals to each demultiplexer 160. For example, the demultiplexer controller 170 supplies a plurality of control signals to each demultiplexer 160 so that the initialization voltage is commonly supplied to the data lines D for each horizontal period, and the plurality of data signals are time-divisionally supplied to the plurality of data lines.

Additionally, the demultiplexer controller 170 controls the demultiplexer 160 so that the data signal is concurrently (e.g., simultaneously) supplied to the green sub-pixels G during a second period and is concurrently (e.g., simultaneously) supplied to the red sub-pixels R during a third period, except a first period in which the initialization voltage is supplied during the horizontal period. In this case, some of the blue sub-pixels B receive the data signal during the second period, and the others of the blue sub-pixels B receive the data signal during the third period.

The timing controller 150 controls the scan driver 110, the data driver 120 and the demultiplexer controller 170, corresponding to synchronization signals supplied from the outside of the organic light emitting display. The timing controller 150 rearranges data Data supplied from the outside, corresponding to a control signal supplied from the demultiplexer controller 170, and supplies the rearranged data to the data driver 120.

Specifically, the timing controller 150 rearranges the data Data so that the data signal can be supplied to the green sub-pixels G during the second period in the horizontal period, corresponding to the control signal. The timing controller 150 also rearranges the data Data so that the data signal can be supplied to the red sub-pixels R during the third period in the horizontal period, corresponding to the control signal.

Although it has been illustrated in FIG. 1 that the demultiplexer 160 is coupled to two data lines, embodiments of the present invention are not limited thereto. According to embodiments of the present invention, each demultiplexer 160 may be coupled to two or more data lines. The demultiplexer controller 170 may be provided inside the timing controller 150.

Figure 2:
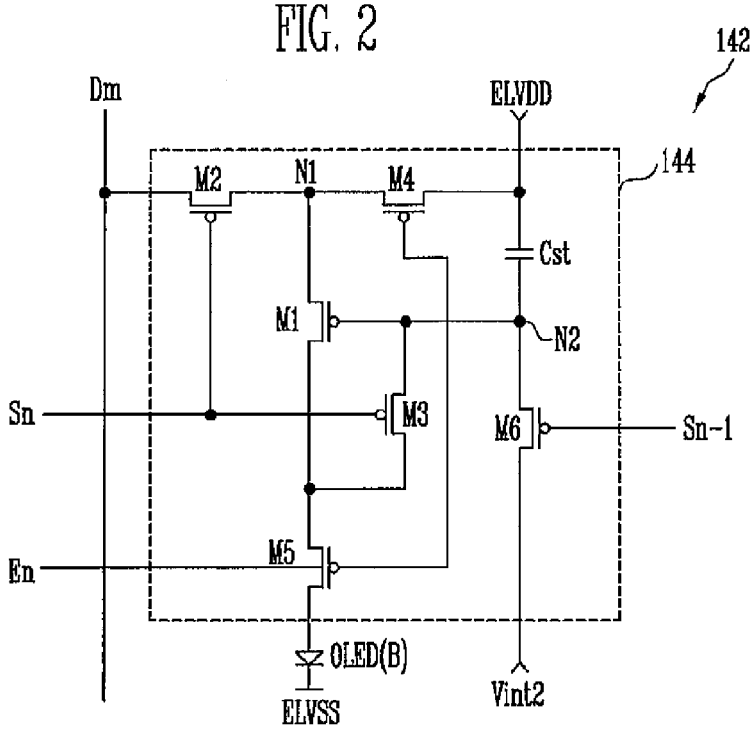
FIG. 2 is a circuit diagram illustrating a sub-pixel according to an embodiment of the present invention.

FIG. 2 is a circuit diagram illustrating a sub-pixel according to an embodiment of the present invention. For convenience of illustration, a sub-pixel coupled to an n-th scan line Sn and an m-th data line Dm will be shown in FIG. 2.

Referring to FIG. 2, the sub-pixel 142 according to this embodiment includes an organic light emitting diode OLED (B) and a pixel circuit 144 configured to control the amount of current supplied to the organic light emitting diode OLED(B).

An anode electrode of the organic light emitting diode OLED(B) is coupled to the pixel circuit 144, and a cathode electrode of the organic light emitting diode OLED(B) is coupled to the second power source ELVSS. The organic light emitting diode OLED(B) generates light with a luminance (e.g., a predetermined luminance) corresponding to the amount of current supplied from the pixel circuit 144.

The pixel circuit 144 stores a voltage corresponding to a data signal and the threshold voltage of a first transistor (e.g., the driving transistor) M1, and controls the amount of the current supplied to the organic light emitting diode OLED (B), corresponding to the stored voltage. To this end, the pixel circuit 144 includes first to sixth transistors M1 to M6, and a storage capacitor Cst.

A first electrode of the first transistor M1 is coupled to a first node N1, and a second electrode of the first transistor M1 is coupled to a first electrode of the fifth transistor M5. A gate electrode of the first transistor M1 is coupled to a second node N2. The first transistor M1 controls the amount of the current supplied to the organic light emitting diode OLED(B), corresponding to a voltage stored in the storage capacitor Cst.

A first electrode of the second transistor M2 is coupled to the data line Dm, and a second electrode of the second transistor M2 is coupled to the first node N1. A gate electrode of the second transistor M2 is coupled to the n-th scan line Sn. The second transistor M2 is turned on when a scan signal is supplied to the n-th scan line, to supply a data signal from the data line Dm to the first node N1.

A first electrode of the third transistor M3 is coupled to the second electrode of the first transistor M1, and a second electrode of the third transistor M3 is coupled to the second node N2. A gate electrode of the third transistor M3 is coupled to the n-th scan line Sn. The third transistor M3 is turned on when the scan signal is supplied to the n-th scan line Sn, to allow the first transistor M1 to be diode-coupled.

A first electrode of the fourth transistor M4 is coupled to the first power source ELVDD, and a second electrode of the fourth transistor M4 is coupled to the first node N1. A gate electrode of the fourth transistor M4 is coupled to an emission control line En. The fourth transistor M4 is turned off when an emission control signal is supplied to the emission control line En, and is turned on otherwise. For example, the emission control signal is a logic high signal in this embodiment.

The first electrode of the fifth transistor M5 is coupled to the second electrode of the first transistor M1, and a second electrode of the fifth transistor M5 is coupled to the anode electrode of the organic light emitting diode OLED(B). A gate electrode of the fifth transistor M5 is coupled to the emission control line En. The fifth transistor M5 is turned off when the emission control signal is supplied to the emission control line En, and is turned on otherwise.

A first electrode of the sixth transistor M6 is coupled to the second node N2, and a second electrode of the sixth transistor M6 is coupled to a second initialization power source Vint2. A gate electrode of the sixth transistor M6 is coupled to an (n−1)-th scan line Sn−1. The sixth transistor M6 is turned on when the scan signal is supplied to the (n−1)-th scan line Sn−1, to supply the voltage of the second initialization power source Vint2 to the second node N2. Here, the second initialization power source Vint2 may be set to a voltage lower than the data signal, e.g., a voltage equal to the initialization voltage supplied to the output lines O1 to Om/2.

The storage capacitor Cst is coupled between the first power source ELVDD and the second node N2. The storage capacitor Cst stores a voltage corresponding to the data signal and the threshold voltage of the first transistor M1.

An operating process of the sub-pixel 142 according to an embodiment of the present invention will be briefly described. First, the emission control signal is supplied to the emission control line En so that the fourth and fifth transistors M4 and M5 are turned off. When the fourth and fifth transistors M4 and M5 are turned off, the sub-pixel 142 is set in a non-emission state.

Subsequently, the scan signal is supplied to the (n−1)-th scan line Sn−1 so that the sixth transistor M6 is turned on. When the sixth transistor M6 is turned on, the voltage of the second initialization power source Vint2 is supplied to the second node N2, and accordingly, the second node N2 is initialized with the voltage of the second initialization power source Vint2.

Subsequently, the scan signal is supplied to the n-th scan line Sn so that the second and third transistors M2 and M3 are turned on. When the third transistor M3 is turned on, the first transistor M1 is diode-coupled. When the second transistor M2 is turned on, the data line Dm and the first node N1 are electrically coupled to each other.

In a case where an initialization voltage Vint is supplied to the data line Dm, the first transistor M1 is set in a turn-off state. Subsequently, when the data signal is supplied to the data line Dm, the first transistor M1 is turned on. When the first transistor M1 is turned on, the voltage corresponding to the data signal and the threshold voltage of the first transistor M1 is applied to the second node N2.

Subsequently, the supply of the emission control signal to the emission control line En is stopped so that the fourth and fifth transistors M4 and M5 are turned on. Then, the first transistor M1 controls the amount of current flowing from the first power source ELVDD to the second power source ELVSS via the organic light emitting diode OLED(B), corresponding to the voltage applied to the second node N2. In this case, the organic light emitting diode OLED(B) generates light with a luminance (e.g., a predetermined luminance) corresponding to the amount of the current.

In embodiments of the present invention, the pixel circuit 144 may be implemented as various types of circuits currently known in the art.

Figure 3:
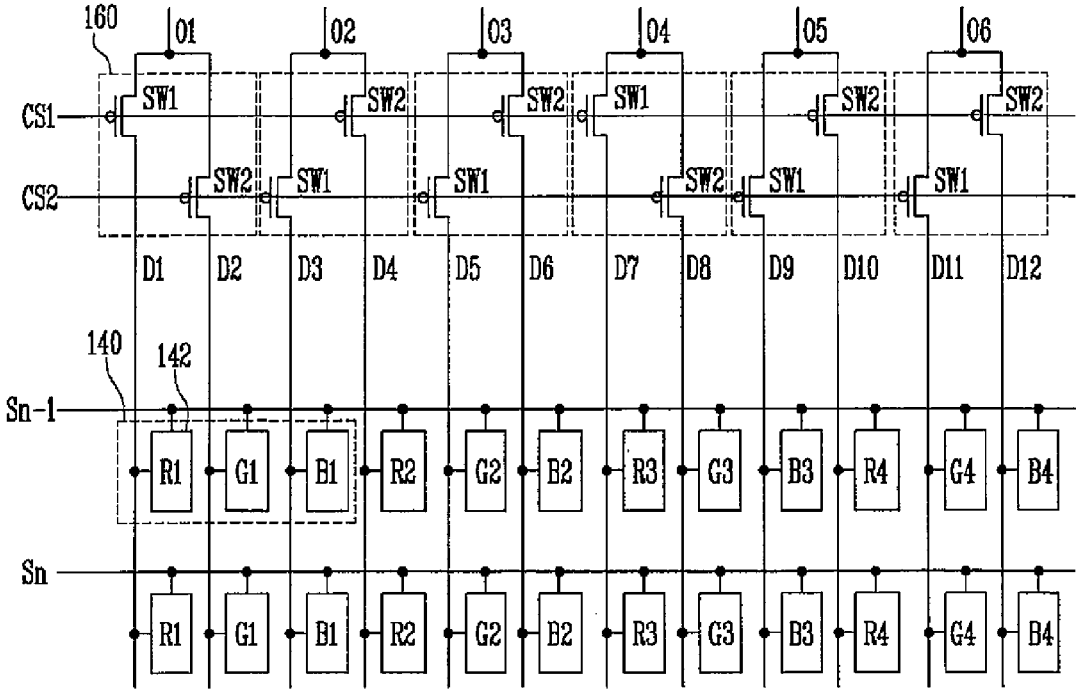
FIG. 3 is a diagram illustrating demultiplexers according to an embodiment of the present invention.

FIG. 3 is a diagram illustrating demultiplexers according to an embodiment of the present invention. For convenience of illustration, a demultiplexer coupled to first to sixth output lines O1 to O6 will be shown in FIG. 3.

Referring to FIG. 3, each demultiplexer 160 according to this embodiment includes a first switch SW1 and a second switch SW2. The first and second switches SW1 and SW2 are coupled between the same output line O and different data lines D. The first switch SW1 is coupled to a data line positioned at one side of the demultiplexer 160, and the second switch SW2 is coupled to a data line positioned at the other side of the demultiplexer 160. For example, the first switch SW1 included in a first demultiplexer 160 is coupled between a first output line O1 and a first data line D1, and the second switch SW2 included in the first demultiplexer 160 is coupled between the first output line O1 and a second data line D2. The first and second switches SW1 and SW2 are turned on corresponding to first and second control signals CS1 and CS2, respectively, to control the coupling between the output lines O and the data lines D.

The first switch SW1 included in a demultiplexer 160 coupled to an i-th (i is 1, 4, 7, . . . ) output line Oi is turned on when the first control signal CS1 is supplied, and the second switch SW2 included in the demultiplexer 160 is turned on when the second control signal CS2 is supplied. The first switch SW1 included in a demultiplexer 160 coupled to (i+1)-th and (i+2)-th output lines Oi+1 and Oi+2 is turned on when the second control signal CS2 is supplied, and the second switch SW2 included in the demultiplexer 160 is turned on when the first control signal CS1 is supplied.

The sub-pixels 142 are positioned at the crossing regions of the scan lines S1 to Sn and the data lines D1 to Dm. For convenience of illustration, sub-pixels 142 included in the same pixel 140 are designated by like reference numerals R1, G1, B1, . . . , and sub-pixels 142 included in different pixels 140 are designated by different reference numerals R1, R2, R3, . . . .

Figure 4:
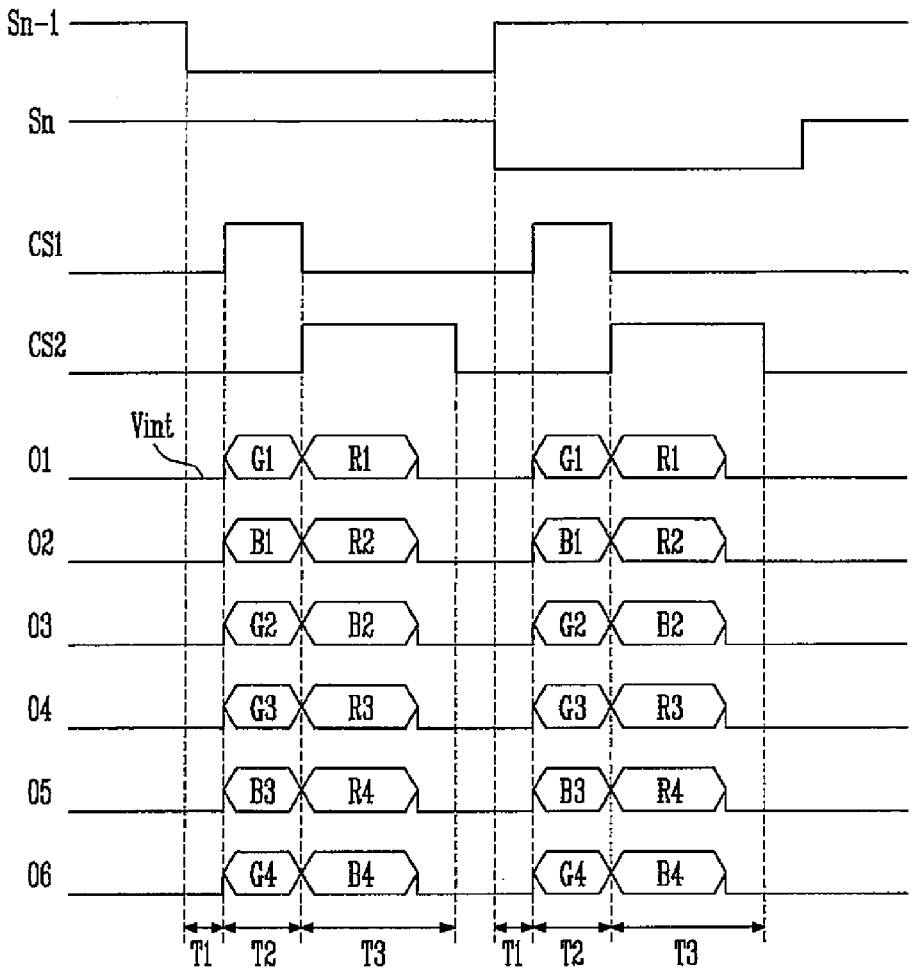
FIG. 4 is a waveform diagram illustrating an embodiment of an operating process of the demultiplexers shown in FIG. 3.

FIG. 4 is a waveform diagram illustrating an embodiment of an operating process of the demultiplexers shown in FIG. 3.

Referring to FIG. 4, one period in which the scan signal is supplied, i.e., one horizontal period, is divided into a first period T1, a second period T2 and a third period T3.

The first and second control signals CS1 and CS2 are concurrently (e.g., simultaneously) supplied during the first period T1. The second control signal CS2 is supplied during the second period T2, and the first control signal CS1 is supplied during the third period T3.

The operating process of the demultiplexers will be described in more detail. First, during the first period T1, the first and second control signals CS1 and CS2 are supplied, and concurrently (e.g., simultaneously), the initialization voltage Vint is supplied to the output lines O1 to O6.

When the first and second control signals CS1 and CS2 are supplied, the first and second switches SW1 and SW2 included in each demultiplexer 160 are turned on. Then, the initialization voltage Vint supplied to the output lines O1 to O6 is supplied to data lines D1 to D12, and accordingly, the data lines D1 to D12 are initialized with the initialization voltage Vint.

When the data lines D1 to D12 are initialized with the initialization voltage Vint, the driving transistor M1 maintains the turn-off state even though the driving transistor M1 is diode-coupled corresponding to the scan signal supplied to the scan lines Sn−1 and Sn.

Subsequently, the second control signal CS2 is supplied during the second period T2. When the second control signal CS2 is supplied, the second switch SW2 coupled to the i-th output line Oi and the first switch SW1 coupled to the (i+1)-th and (i+2)-th output lines Oi+1 and Oi+2 are turned on.

Then, the data signal is supplied to green sub-pixels G1 to G4 and blue sub-pixels B1 and B3. Here, the green sub-pixels G1 to G4 concurrently (e.g., simultaneously) receive the data signal during the second period T2. That is, in embodiments of the present invention, the data signal is first of all applied to the green sub-pixels G1 to G4. When the data signal is first of all applied to the green sub-pixels G1 to G4, the charging time of the green sub-pixels G1 to G4 increases, and accordingly, it is possible to reduce (or prevent) a luminance difference from occurring due to inequality of the charging times.

Subsequently, the first control signal CS1 is supplied during the third period T3. When the first control signal CS1 is supplied, the first switch SW1 coupled to the i-th output line Oi and the second switch SW2 coupled to the (i+1)-th and (i+2)-th output lines Oi+1 and Oi+2 are turned on.

Then, the data signal is supplied to red sub-pixels R1 to R4 and blue sub-pixels B2 and B4. Here, the red sub-pixels R1 to R4 concurrently (e.g., simultaneously) receive the data signal during the third period T3. When the data signal is concurrently (e.g., simultaneously) supplied to the red sub-pixels R1 to R4, it is possible to reduce (or prevent) a luminance difference from occurring due to inequality of the charging times.

Generally, the green sub-pixel G contributes to luminance by about 60%, the red sub-pixel R contributes to luminance by about 30%, and the blue sub-pixel B contributes to luminance by about 10%. In embodiments of the present invention, the data signal is concurrently (e.g., simultaneously) supplied to the green sub-pixels G during the second period T2. Then, the charging time of the green sub-pixels G increases, and the luminance difference may not occur due to the inequality of the charging times. Similarly, in embodiments of the present invention, the data signal is concurrently (e.g., simultaneously) supplied to the red sub-pixels R during the third period T3, so that it is possible to reduce (or prevent) a luminance difference from occurring due to the inequality of the charging times.

The data signal supplied to the blue sub-pixels B is divided and supplied during the second and third periods T2 and T3. However, the blue sub-pixels B may not (or hardly) contribute to luminance, and hence the inequality phenomenon caused by the luminance may not observed.

By way of summation and review, an organic light emitting display according to embodiments of the present invention includes a plurality of sub-pixels arranged in a matrix form at crossing regions of data lines, scan lines and power lines. Each sub-pixel generally includes two or more transistors. In embodiments of the present invention, each sub-pixel includes an organic light emitting diode and a driving transistor, and one or more capacitors.

In order to reduce manufacturing costs of the organic light emitting display, there has been proposed a structure in which demuitiplexers are respectively added to output lines of a data driver. The demultiplexer time-divisionally supplies, to a plurality of data lines, a plurality of data signals supplied to each output line. However, in a case where the data signals are time-divisionally supplied, an unequal image may be displayed due to a difference in charging time amongst sub-pixels.

Practically, the data signal is supplied to the green sub-pixels that highly contribute luminance for different times, the voltage is changed (e.g., the luminance difference occurs) corresponding to the charging time, and accordingly, a defect may occur, such as a blurry shape.

In the organic light emitting display and the driving method thereof according to embodiments of the present invention, the data signal is first of all supplied to the green sub-pixels that highly contribute luminance when the demultiplexer is used. Then, the charging time of the green sub-pixels increases, thereby increasing (or improving) display quality. Further, when the demultiplexer is used, the data signal is concurrently (e.g., simultaneously) supplied to the red sub-pixels, thereby reducing (or preventing) the occurrence of a luminance difference.

Example embodiments have been disclosed herein, and although specific terms are employed, they are used and are to be interpreted in a generic and descriptive sense only and not for purpose of limitation. In some instances, as would be apparent to one of ordinary skill in the art as of the filing of the present application, features, characteristics, and/or elements described in connection with a particular embodiment may be used singly or in combination with features, characteristics, and/or elements described in connection with other embodiments unless otherwise specifically indicated. Accordingly, it will be understood by those of skill in the art that various changes in form and details may be made without departing from the spirit and scope of the present invention as set forth in the following claims, and equivalents thereof.

What is claimed is:

1. An organic light emitting display comprising:

a plurality of pixels comprising first sub-pixels, second sub-pixels and third sub-pixels at an area defined by scan lines and data lines;

a data driver configured to supply an initialization voltage and data signals to output lines;

demultiplexers coupled to respective ones of the output lines, each demultiplexer being configured to supply a plurality of the data signals to a plurality of the data lines; and a demultiplexer controller configured to control the demultiplexers so that the data signals are concurrently supplied to at least one of the first sub-pixels, the second sub-pixels or the third sub-pixels of the plurality of pixels, wherein each of the demultiplexers comprises a first switch and a second switch, wherein each of the first and second switches is a single transistor, wherein the first switch coupled to an i-th (i is only 1, 4, 7, . . . ) output line is turned on when a first control signal is supplied from the demultiplexer controller, and the second switch coupled to the i-th output line is turned on when a second control signal is supplied from the demultiplexer controller, and wherein the first switch coupled to (i+1)-th and (i+2)-th output lines is turned on when the second control signal is supplied from the demultiplexer controller such that the data signals supplied to the (i+1)-th and (i+2)-th output lines are supplied to data lines corresponding to the first switches while the first switches are turned on, and the second switch coupled to the (i+1)-th and (i+2)-th output lines is turned on when the first control signal is supplied from the demultiplexer controller such that the data signals applied to the (i+1)-th and (i+2)-th output lines are supplied to data lines corresponding to the second switches while the second switches are turned on.

2. The organic light emitting display of claim 1, wherein the demultiplexer controller is configured to control the demultiplexer so that the initialization voltage is supplied to the data lines during a first period in a horizontal period, one of the data signals is supplied to the first sub-pixels during a second period in the horizontal period, and another one of the data signals is supplied to the second sub-pixels during a third period in the horizontal period.

3. The organic light emitting display of claim 2, wherein the first sub-pixels are green sub-pixels configured to generate green light.

4. The organic light emitting display of claim 2, wherein the second sub-pixels are red sub-pixels configured to generate red light.

5. The organic light emitting display of claim 2, wherein one of the data signals supplied to the third sub-pixels is supplied during the second and third periods.

6. The organic light emitting display of claim 2, further comprising a timing controller configured to rearrange external data, corresponding to an order of the data signals supplied to the first sub-pixels, the second sub-pixels and the third sub-pixels, and configured to supply the rearranged data to the data driver.

7. The organic light emitting display of claim 2, wherein the demultiplexer controller is configured to supply the first and second control signals during the first period, supply the second control signal during the second period, and supply the first control signal during the third period.

8. The organic light emitting display of claim 2, wherein the first switch is coupled to one of the data lines at one side of the demultiplexer, and wherein the second switch is coupled to one of the data lines at an other side of the demultiplexer.

9. The organic light emitting display of claim 1, wherein the initialization voltage is a voltage lower than a voltage of the data signals.

* * * * *